United States Patent [19]

Kopp et al.

[11] Patent Number: 4,457,613

[45] Date of Patent: Jul. 3, 1984

[54] MIXING DEVICE FOR BLENDING A DEVELOPER CONSISTING OF CARRIER PARTICLES AND TONER

[75] Inventors: Walter Kopp, Taufkirchen; Karl-Heinz Saalmueller, Munich, both of Fed. Rep. of Germany

[73] Assignee: Siemens Aktiengesellschaft, Berlin & Munich, Fed. Rep. of Germany

[21] Appl. No.: 369,832

[22] Filed: Apr. 19, 1982

[30] Foreign Application Priority Data

Apr. 30, 1981 [DE] Fed. Rep. of Germany ..... 3117309

[51] Int. Cl.[3] ..... G03G 15/08; G03G 15/09

[52] U.S. Cl. ..... 355/3 DD; 355/14 D; 118/658; 366/181

[58] Field of Search ..... 355/3 DD, 14 D; 118/668, 688, 689, 691, 612, 658; 430/30; 366/181, 158; 222/DIG. 1

[56] References Cited

U.S. PATENT DOCUMENTS

| | | | |
|---|---|---|---|
| 3,784,297 | 1/1974 | Ito et al. | 355/3 |
| 3,883,240 | 5/1975 | Ito et al. | 355/3 DD |
| 4,347,299 | 8/1982 | Ozawa et al. | 355/3 DD X |
| 4,354,763 | 10/1982 | Koiso et al. | 355/3 DD X |
| 4,370,053 | 1/1983 | Hirayama et al. | 355/3 DD X |

FOREIGN PATENT DOCUMENTS 2165416 7/1972 Fed. Rep. of Germany .

*Primary Examiner*—A. C. Prescott

*Attorney, Agent, or Firm*—Hill, Van Santen, Steadman & Simpson

[57] ABSTRACT

In a developer station for an electrophotographic printing or copying machine, there is provided mixing apparatus for mixing fresh toner with developer mix particles and maintaining an adequate concentration of toner in the developer mix particles being picked up and carried for inking by the developer drum. The apparatus comprises a first mixing screw disposed along the floor of the developer station for conducting particles in a first direction along the length of the developer drum and a second mixing screw disposed in a partitioned off mixing chamber lying above the level of the first mixing screw which receives a portion of the developer particles carried by the developer drum off one end of the drum by means of a scraper plate. The second mixing screw is disposed in the mixing chamber for passing particles in a direction opposite to that of the conveying direction of the first mixing screw. The partition wall is formed with an opening such that the discharge end of the second mixing screw communicates with the lead end of the first mixing screw. In the mixing chamber, fresh toner particles are mixed with that portion of the used developer particles conducted by the scraper plate and this blend is mixed during transport along the second screw.

6 Claims, 2 Drawing Figures

12
II
20
22
18
10
22
26
14
42
16
24
N
S

MIXING DEVICE FOR BLENDING A DEVELOPER CONSISTING OF CARRIER PARTICLES AND TONER

RELATED APPLICATIONS

This application concerns subject matter which relates to the following commonly assigned U.S. patent applications, all filed Apr. 19, 1982:

Ser No. 369, 897 entitled "Device for Removing the Developer Mix from a Developing Station", Serial No. 369,833 entitled "Developing Device for Developing Charge Images on a Charge Image Carrier", and Serial No. 369,834 entitled "Developing Station for Developing Charge Images on a Charge Image Carrier".

BACKGROUND OF THE INVENTION

The invention relates to apparatus for mixing or blending developer mix particles consisting of carrier and toner in a developer station of a non-mechanical printing or copying machine.

Typically non-mechanical printing or copying machines function according to electrophotographic principles, wherein electrostatic latent images of characters to be printed are generated on a recording medium, such as a photoconductive drum. The drum has on it a semi-conductor layer of photo-electrical or di-electrical material on which electrostatic charge images of the characters to be printed or copied are generated. These electrostatic images are subsequently inked with a toner powder, which is typically black, in a developer station. The toner images are subsequently transferred to sheet paper on which they are fixed. The developer station typically includes at least one developer unit generally referred to in the art as a magnetic brush developer. The magnetic brush developer, as a rule, contains a magnetic brush or drum mounted for rotation so as to continually bring particle developer mix, consisting of iron carrier particles and toner powder particles, into contact with the electrostatic images recorded on the photoconductive drum surface. The charge images are inked by adherence of toner particles to the charge images, due to electrostatic forces. The general principles of developer station construction are known in the art as shown, for example, in U.S. Pat. Nos. 3,784,297 and 3,883,240.

During developer operation, toner is continuously removed from the developer station by adherence to the character charge images. Thus, the concentration of toner in the developer mix, that is the percentage of toner particles to carrier particles, is constantly decreasing in the developer station and new toner must be supplied to the station in order to make up for that which is lost. It is necessary, in order to maintain a lever of inking quality in the developer mix, to enable to newly supplied toner to uniformly mix with the toner-depleted body of mix. One known mixing device is disclosed in U.S. Pat. Nos. 3,784,297 and 3,883,240. The mixing device comprises two mixing screws disposed side-by-side in a developer station separated from one another by a partition wall. The mixing screws are arranged to convey particles in opposite directions. Developer mix falling back into the developer station from the top of the developer or magnetic drum after being conducted to the charge image surface of the printing or copying machine photoconductive drum drops back into the area of the two mixing screws. Particle flow along the mixing screws is serial with the outer screw feeding its conveyed particles to the inner screw disposed adjacent the developer drum. New toner particles are received from a reservoir hopper by the outer screw such that the screws serve to blend the newly supplied toner into the developer mix body. An opening in the partition wall enables the particles from the outer screw to be conveyed to the innter screw.

An object of the present invention is to provide apparatus in a developer station by which two mixing screws are arranged to provide a high level of mixing or blending of developer mix and new toner particles in high-speed printing and copying machines.

SUMMARY OF THE INVENTION

In a developer station for an electrophotographic printing or copying machine, there is provided a pair of parallel arranged rotary screws which serve to conduct developer mix particles within the station. The developer station housing is divided into a principal chamber containing at least one developer or magnetic drum for bringing developer mix into contact with a suitable charge image carrier, such as a photoconductive drum, and a smaller mixing chamber area. A laterally disposed partition wall serves to divide the principal chamber from the mixing chamber.

The first mixing screw is disposed in the principal chamber adjacent to the developer drum. This mixing screw is disposed along the bottom floor of the station within the main body of developer mix for moving mix particles, while at the same time blending the developer mix, along the length of the developer drum in a lateral direction from one sidewall of the station to the opposed station sidewall.

The second mixing screw is disposed in the mixing chamber behind the partition wall at a region substantially spaced laterally and vertically from the first mixing screw. This second mixing screw serves to convey developer particles and newly added toner particles within the developer station between the opposed station sidewalls in the lateral direction opposite of the conveying direction of the first screw. The mixing chamber is open from above and a scraping plate directed along an angle slanted from vertical is seated adjacent the opposed station sidewall in such a manner that a portion of the developer mix particles being transported by the developer drum fall onto the plate and are conducted into the mixing chamber and onto the lead end of the second mixing screw.

The inventive apparatus enables the blending of new toner particles into toner-depleted developer mix in a manner which achieves a high level of uniform distribution even at high speeds. This enhances the inking quality of the developer mix, since developer inking is only possible when newly supplied toner has been blended substantially uniformly into the main body of mix. Moreover, the arrangement of the mixing screws in the station assures a constant friction of carrier particles against one another as new toner is fed to the main mix body such that the tribo-electrical properties of the carrier particles are maintained at a consistently high level throughout the course of the useful life of the mix.

The newly supplied toner transferred from the mixing chamber into the principal chamber is prevented from floating on top of the main body of developer mix in that the toner feed opening is disposed in the developer station overlying the mixing chamber at that area where developer mix particles falling from the developer drum are conveyed off the scraper plate.

Uniform inking of the charge images on the moving image carrier is further improved by virtue of the inventive apparatus in that the mixing chamber opens toward the principal chamber for only approximately one-third of its overall length.

DESCRIPTION OF THE PREFERRED EMBODIMENT

Figure 1:
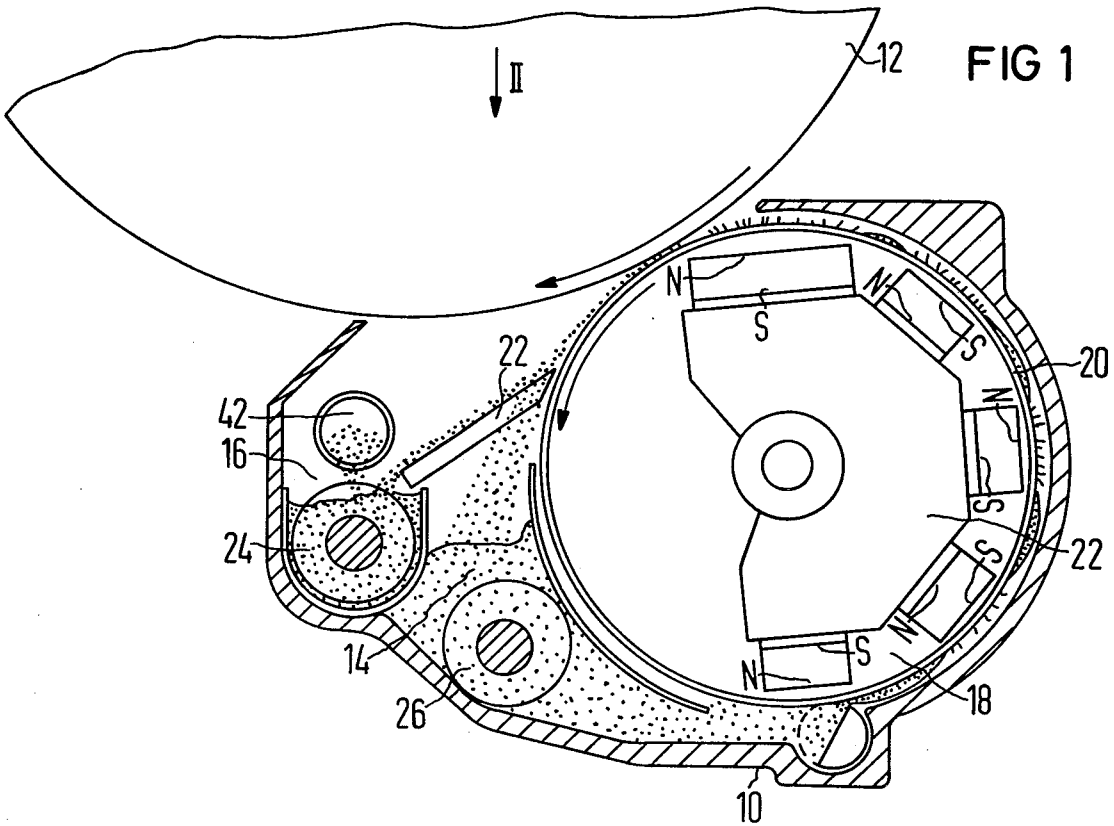
FIG. 1 is a schematic, side elevational cross-sectional view of a developer station having mixing apparatus in accordance with the present invention.

FIG. 1 illustrates a developer station 10 for use in an electrophotographic printing or copying machine. A photoconductive drum 12, which serves as a charge image carrier, is mounted for rotation in the machine in the direction indicated by the arrow for conducting charge images from suitable charging stations (not shown) to the developer station 10 for inking, and then to suitable transfer and cleaning stations (not shown). The developer station 10 is segregated by a laterally extending wall into a principal chamber 14 and a mixing chamber 16. A developer drum 18 is disposed for rotation in the conventional manner within the principal chamber 14. The developer drum 18 comprises a rotating hollow cylinder 20 containing a suitable magnetic arrangement 22. The developer drum 18 serves to conduct developer mix particles, consisting of toner and finally divided iron carrier particles, from a main body disposed on the floor of the principal chamber 14 into contact with the charge image surfaces of the photoconductive drum 12. The charge images present on the drum 12 are inked with toner particles along the nip formed between the drums 12 and 18. That portion of the developer mix carried by the magnetic drum 18 which does not adhere to the charge images present on the photoconductive drum 12 spills off under the influence of gravity from the top of the magnetic drum 18 as it passes through the nip. A portion of the spilled back developer mix falls directly into the principal chamber 14 and the remaining portion of the spilled back mix is conducted into the mixing chamber 16 along a downwardly angled scraping plate 22 disposed between the upper end of the magnetic drum 18 and the partition wall of the mixing chamber 16. The scraping plate 22 is seated against a first lateral sidewall of the station housing.

Figure 2:
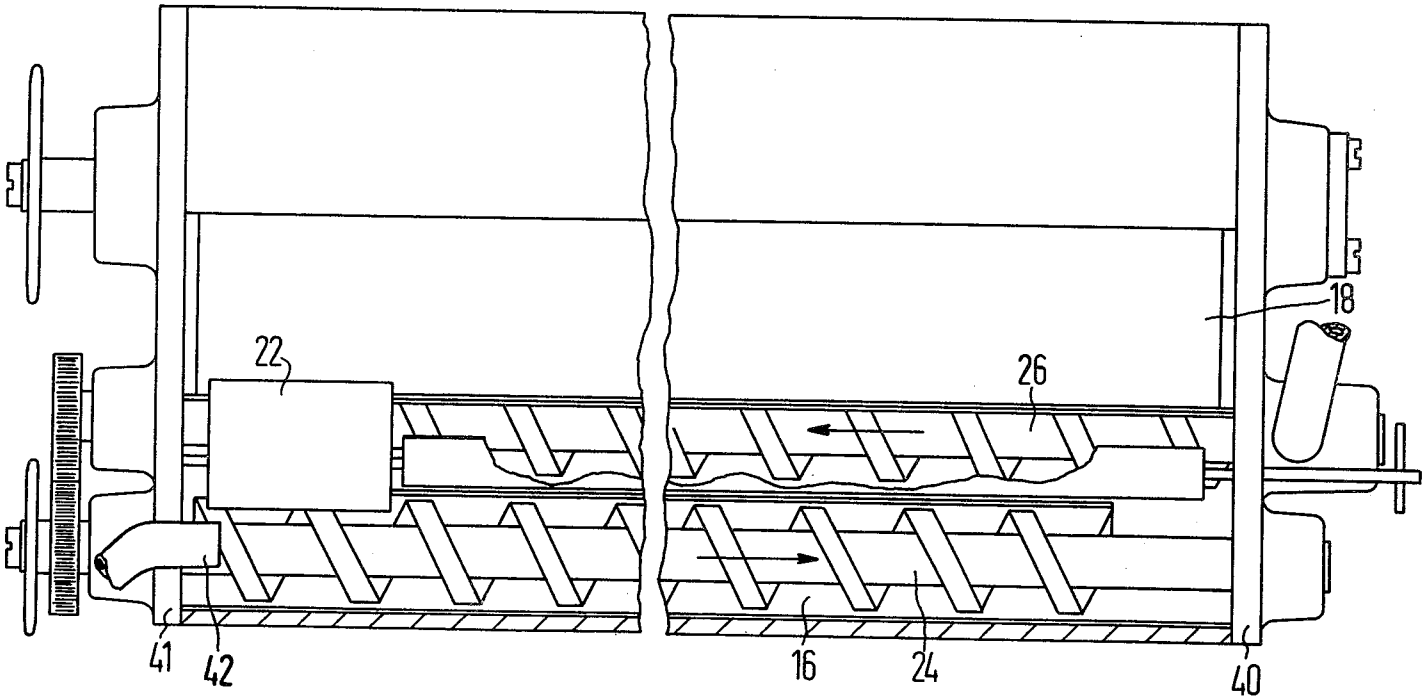
FIG. 2 is a partial plan view of the developer station of FIG. 1 in the direction II of FIG. 1.

As shown in FIGS. 1 and 2, a first mixing screw 26 is disposed for rotation along the floor of the developer station immediately adjacent to the developer drum 18. The mixing screw 26 acts within the main body of developer mix to conduct developer mix particles along the length of the developer drum 18 in the direction of the arrow shown in FIG. 2. The developer drum picks up developer mix from the main body, conducts it to the inking nip and then spills a portion of the unused developer mix back into the principal chamber 14 where it is again blended with the main body of mix with the assistance of the first mixing screw 26.

A second mixing screw is disposed for rotation within the mixing chamber 16 about an axis parallel to the axis of rotation of the first mixing screw 26. Particles conducted by the second mixing screw 24 are conveyed in a direction opposed to that of the transfer direction of the first mixing screw as indicated by the arrow in FIG. 2.

A fresh supply of toner particles are fed into the developer station from a suitable reservoir means through a feed opening 42 formed in the lateral sidewall of the station housing on which the scraper plate 22 is seated. The fresh toner is deposited into the mixing chamber 16 where it is picked up along with the used mix particles passed into the mixing chamber by the scraper plate by the second mixing screw 24. The new toner is blended with that portion of the used developer particles deposited from the scraper plate 22 along the conveyance path of the second mixing screw 24 and this blend is subsequently resupplied into the principal chamber 14 through a discharge end opening formed in the partition wall. In order to promote the passage of particles from the mixing chamber 16 into the principal chamber 14, the mixing chamber 16 and the rotary screw 24 disposed therein are located within a lateral plane vertically above the lateral plane in which the first mixing screw 26 is disposed in the principal chamber 14. The connecting opening in the partition wall between the mixing chamber 16 and the principal chamber 14 faces into the principal chamber.

The mixing screws 24 and 26 are disposed substantially the lateral length between the opposed lateral sidewalls 40 and 41 of the developer station housing as shown in FIG. 2. The first mixing screw 26 conducts developer mix particles in a direction from the sidewall 40 to the opposed sidewall 41; whereas the second mixing screw 24 conveys developer particles in the opposite direction.

As shown in FIG. 1, the mixing chamber 16 is considerably smaller than the principal chamber 14. By virtue of the transport directions of the mixing screws 26 and 24, developer mix particles conveyed by the developer drum 18 from the main body of developer mix, which has a toner concentration adequate for developer inking, are for the most part spilled back from the drum 18 into that area of the principal chamber 14 where the lead end of the first mixing screw 26 is located. The mixing screw 26 serves to conduct developer particles after being repeatedly picked up by the developer drum 18 and spilled back into the principal chamber 14 toward the area adjacent the lateral sidewall 41. The toner concentration in the developer mix main body is such that these repeated uses of the developer mix particles reaches a near toner depletion level by the time the mix particles are deposited adjacent the sidewall 41. When the toner-depleted developer has arrived at the end of the developer drum adjacent the sidewall 41, it is picked up by the drum 18 and passed to the mixing chamber 16 over the scraper plate 22. In the mixing chamber 16 the toner-depleted developer is agains enriched with a fresh supply of toner. Accordingly the new toner particles are deposited into the mixing chamber 16 precisely at that area where used developer mix is dumped into the mixing chamber 16 by the scraper plate 22. This mixing of fresh toner with used developer mix particles at one area of the mixing chamber 16 has the advantage that the toner is immediately buried by the used developer and, thus, cannot float on the developer mix particles being conducted by the second mixing screw 24.

The newly supplied toner and the toner-depleted developer mix are blended by means of the second mixing screw 24 during transport along the length of the mixing chamber 16. Both the first and second mixing screws 26 and 24 mill the developer particles to such a high degree that sufficient tribo-electricity is generated and, thus, optimum charged conditions exist between the toner and carrier particles.

The opening in the partition wall communicating the mixing chamber 16 with the principal chamber 14 is disposed along only approximately one-third of the length of the mixing chamber. This opening is positioned adjacent the lateral sidewall 40 which is at the discharge end of the rotary screw 24. A length amounting to approximately two-thirds of the length of the mixing chamber is sufficient for the mixing screw 24 to achieve a thorough blending of the fresh toner and used developer mix particles. Since the mixing chamber 16 lies at a higher level than the principal chamber 14, the developer blend leaving the mixing chamber 16 falls readily into the principal chamber 14 for mingling with the main body of developer mix. In the principal chamber 14, the newly supplied blend of developer mix begins passage along the length of the first mixing screw 26 and is repeatedly picked up and carried by the developer drum 18 for inking. The previously described action in the principal chamber 14 is repeated so that uniform blending of fresh toner with developer mix particles is achieved and the near toner-depleted developer particles is that which is conducted to the mixing chamber 16 for enrichment with fresh toner.

Although various minor modifications may be suggested by those versed in the art, it should be understood that we wish to embody within the scope of the patent warranted hereon all such modifications as reasonably and properly come within the scope of our contribution to the art.

We claim as our invention:

1. Apparatus for mixing carrier and toner particles of a developer mix in a developer station housing divided by a partition wall into a principal chamber, containing a main body of developer mix on housing floor and at least one rotatable developer drum for carrying developer mix into contact with a charge image carrier surface, and a mixing chamber, communicating at a first end through an opening in said partition wall with said principal chamber and receiving a supply of fresh toner particles through feed means in an opposed second end, comprising;

a first screw mounted for rotation in said principal chamber on the floor of said housing along the length of said developer drum for conducting developer mix from the first end of said mixing chamber toward the second end, a second screw mounted for rotation in said mixing chamber for conducting fresh toner particles from the second end of said mixing chamber to the first end for passage into said principal chamber through said partition wall opening, and a flow means disposed in said housing between said developer drum and said mixing chamber for conducting only that portion of the developer mix carried by said developer drum adjacent the mixing chamber second end into said mixing chamber second end for blending with the fresh toner particles, such that the major portion of the developer mix carried by said developer drum is spilled back directly into said principal chamber and said first screw serves to convey the spilled back mix progressively along the length of said developer drum for pick up by the developer drum adjacent the second end of said mixing chamber.

2. The apparatus of claim 1, wherein said feed means overlies a discharge end of a scraper plate.

3. The apparatus of claim 1, wherein said first and second screws have parallel axis of rotation.

4. The apparatus of claim 1, wherein said mixing chamber is disposed vertically higher in said housing than said first screw.

5. The apparatus of claim 1, wherein said partition wall opening extends approximately one-third of the length of said mixing chamber.

6. The apparatus of claim 1, wherein said flow means comprises a scraper plate angled downwardly from the upper end of said developer drum to said mixing chamber second end and seated in a sidewall of said housing adjacent said mixing chamber second end.

* * * * *